US007995783B2

(12) United States Patent
Ledbetter et al.

(10) Patent No.: US 7,995,783 B2
(45) Date of Patent: Aug. 9, 2011

(54) PERSONAL SPEAKERS WITH CONNECTION SOURCE AND TARGET

(75) Inventors: Carl Ledbetter, Mercer Island, WA (US); John Ikeda, Seattle, WA (US); Josh Maruska, Seattle, WA (US); Steve Kaneko, Medina, WA (US)

(73) Assignee: Microsoft Corporation, Redmond, WA (US)

( * ) Notice: Subject to any disclaimer, the term of this patent is extended or adjusted under 35 U.S.C. 154(b) by 1243 days.

(21) Appl. No.: 11/554,939

(22) Filed: Oct. 31, 2006

(65) Prior Publication Data

US 2008/0101633 A1 May 1, 2008

(51) Int. Cl.
*H04R 25/00* (2006.01)

(52) U.S. Cl. ..... 381/374; 381/380; 381/384

(58) Field of Classification Search ..... 381/370, 381/374, 380, 384; 181/198, 199
See application file for complete search history.

(56) References Cited

U.S. PATENT DOCUMENTS 7,436,974 B2 * 10/2008 Harper ..... 381/374
2001/0001445 A1 * 5/2001 Gallien ..... 206/453
* cited by examiner

*Primary Examiner* — Brian Ensey

(57) ABSTRACT

To assist headphones and headphone cords from becoming tangled, a connection source is made part of a first speaker enclosure and a connection target is made part of a second speaker enclosure.

14 Claims, 4 Drawing Sheets

PERSONAL SPEAKERS WITH CONNECTION SOURCE AND TARGET

BACKGROUND

Personal media devices are popular devices. The devices usually communicate to users through personal speakers which are often in the form of headphones so that the user can enjoy hearing the media or broadcast with minimal disruption to those nearby. Headphones have advanced from bulky, heavy devices to small bud-like devices that fit and stay within the ear of a user. However, most headphones have cords or wires to communicate signals to the speakers inside the headphones. The cords or wires often become tangled and in some cases, the headphones themselves become entangled. As headphones have become smaller and lighter weight, the problem of tangled wires continues. In addition, when headphones are not playing, often there is no convenient way to store the headphones. For headphones that operate wirelessly, there is a tendency for the individual headphones to become separated and lost. Finally, headphones usually have dedicated right and left speakers and trying to determine which speaker is the right speaker and which is the left speaker can be a challenge, especially when the speakers are small.

SUMMARY

To assist headphones and headphone cords from becoming tangled or wireless headphones from becoming separated and lost, a connection source is made part of a first speaker enclosure and a connection target is made part of a second speaker enclosure. The connection source connects to the connection target to keep the speaker enclosures from becoming tangled. In addition, one or more alignment devices and one or more alignment targets may be added to the first and second speaker enclosures to assist that the speakers maintain a desired position together. The alignment devices may also indicate whether a speaker enclosure is a right speaker enclosure or a left speaker enclosure.

DRAWINGS

DESCRIPTION

Although the following text sets forth a detailed description of numerous different embodiments, it should be understood that the legal scope of the description is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
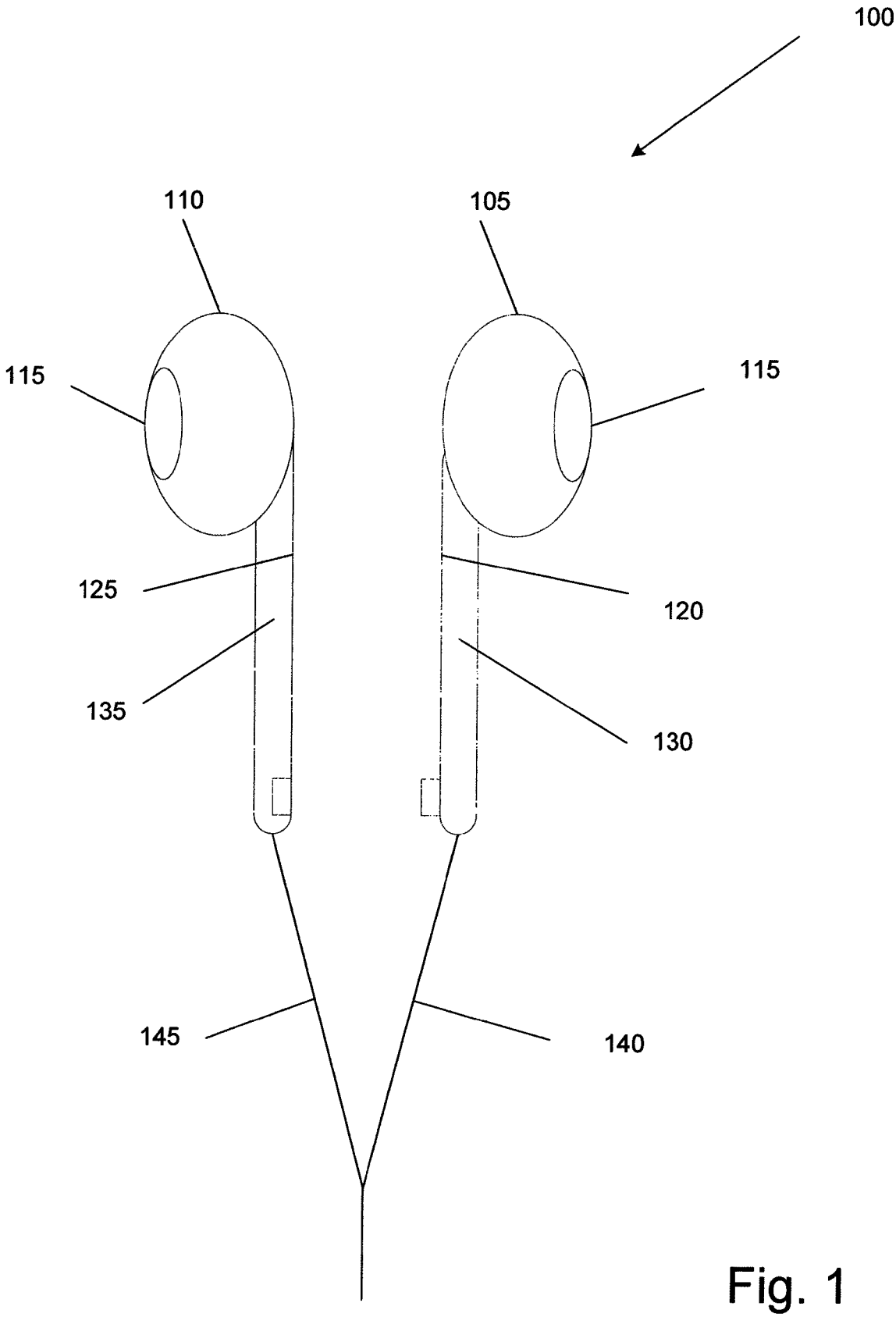
FIG. 1 is an illustration of a set of personal speakers.

FIG. 1 is an illustration of a speaker set 100. The speaker set 100 may be for use within an ear such as a set of ear buds. The speaker set 100 may have a first speaker enclosure 105 and a second speaker enclosure 110. The enclosures 105 110 may be made out of a plastic or other appropriate material where the material is light but durable. Each speaker enclosure 105 110 may contain a speaker 115. As is known, the speaker 115 may be a film or other semi-rigid material attached to a magnet that moves in response to inputs to create sound. The speaker 115 may be of a size to fit inside the speaker enclosures 105 110.

The first speaker enclosure 105 may also have a connection source 120 for connecting the first speaker enclosure 105 to the second speaker enclosure 110. In one embodiment, the connection source 120 may be a magnet. Magnets are well known. The magnet may be chosen to exert sufficient force to attract a connection target 125 that may be part of the second speaker enclosure 110 such as a material that is attracted to a magnet or another magnet. However, the magnet may not have sufficient force to affect the magnets inside the speakers 115. The connection source 120 may also be a male Velcro piece (small, stiff hooks) and the connection target 125 may be a female Velcro piece (small loops that are caught by the small, stiff hooks). In another embodiment, the connection source 120 may be a T-shaped project and the connection receiver 125 may be a slot shaped opening in which the T-shaped projection is inserted and twisted to connect the two speaker enclosures 105 110 together. Other connection sources 120 and targets 125 are contemplated.

The first speaker enclosure 105 may have a first stem 130 and the second speaker enclosure 110 may each have a second stem 135. In one embodiment, both the first stem 130 and second stem 135 have a length longer than a width making the stems 130 135 appear rectangular in shape. Of course, other shapes would be acceptable as long as the speaker enclosures 105 110 may still fit comfortably within an ear of a listener. The stems 130 135 may be integrated into the speaker enclosures 105 110 (molded from the same piece of plastic, for example) or may be separate pieces that are attached to the speaker enclosures 105 110. In one embodiment, the surface of the stems 130 135 opposite of the speaker 115 may be flat such that the stems 130 135 may have a flat surface of the first stem 130 connecting to a flat surface of a second stem 135. In another embodiment, the first stem 130 may be concave and the second stem 135 may be convex and the stems 130 135 may rest within each other. Other arrangements for the stems 130 135 are possible and contemplated.

In one embodiment, a magnet is the connection source 120 and is part of the first stem while the connection target 125 is part of the second stem. The magnet may be housed within the first stem 130 or may be attached to the first stem 130. Similarly, the connection target 125 may be made entirely of a material that is attracted by the magnet, the material that is attracted by the magnet may be housed within the second stem 135 or the material that is attracted by the magnet may be attached to the second stem 135.

In the embodiment where the first stem 130 and second stem 135 are longer than they are wide, the connection source 120 also may have a length longer than a width and the connection source 120 may be disposed along the length of the first stem 130. Related, the connection target 125 may have a length longer than a width and the connection target 125 may be disposed along the length of the second stem 135. The result of such an arrangement may be that the length of the first stem 130 may be attracted to the length of the second stem 135 such that the first stem 130 and second stem 135 may align and the speaker in the first speaker enclosure 105 will be aligned opposite of the speaker in the second speaker enclosure 110. FIG. 1 may be an illustration of the stems 130 135 aligning and the speakers 115 being aligned opposite each other.

Figure 2:
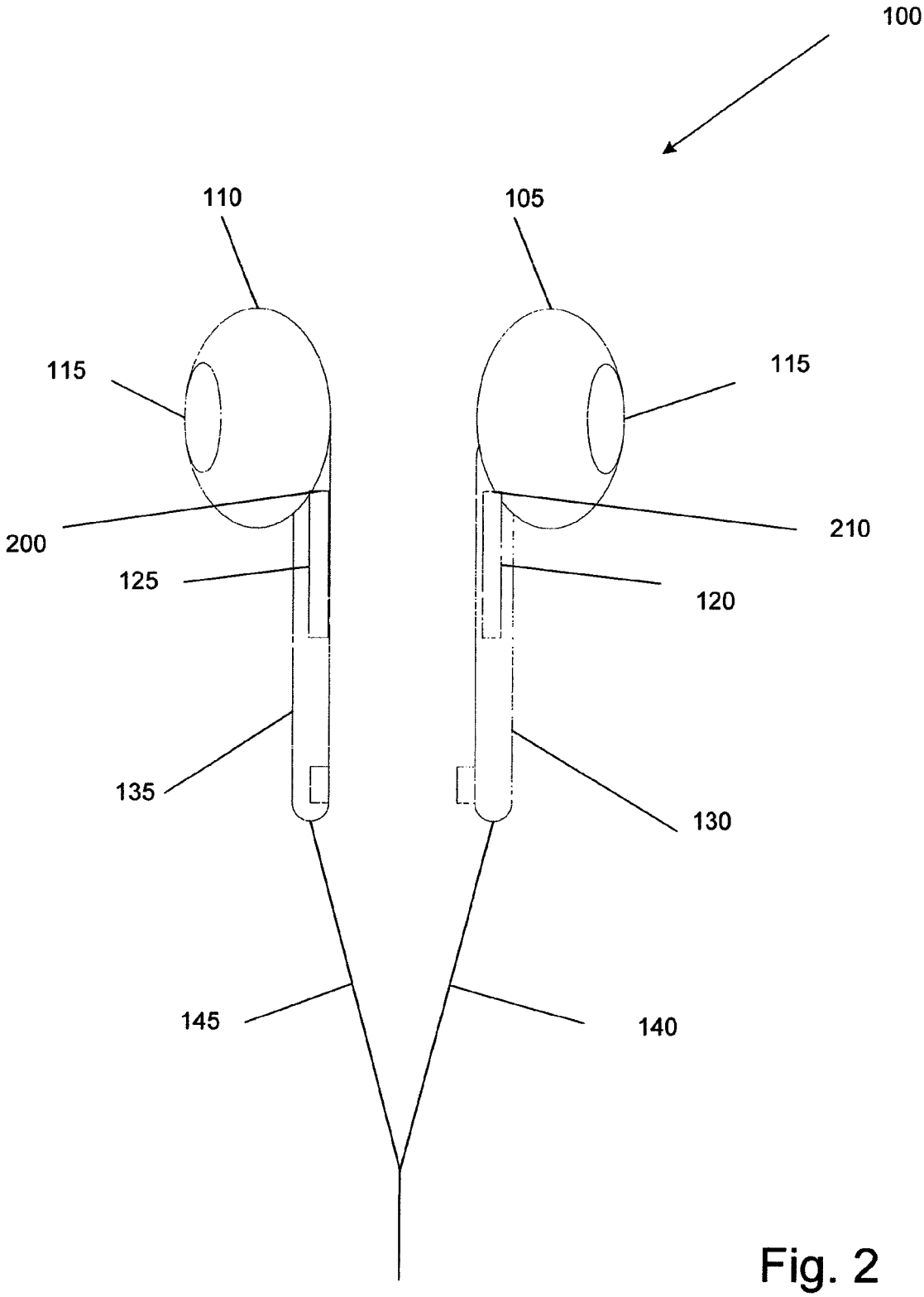
FIG. 2 is an illustration of a set of personal speakers with a magnet as the connection source.

As is known, magnets have north poles and south poles and north poles are attracted to south poles and south poles are attracted to north poles. Referring to FIG. 2, in the embodiment where the connection source 120 is a magnet and the connection target 125 is a magnet, the magnets may be installed such that the magnet in the first stem 130 has the north end 200 of the magnet closest to the speaker 115 and the magnet in the second stem 135 has the south end 210 of the magnet closest to the speaker 115 such that a speaker 115 end of the first speaker enclosure 105 may be attracted to the speaker 115 end of the second speaker enclosure 110 rather than have the speaker 115 end of the first stem 130 attracted to the non speaker 115 end of the second stem 135.

As a result of the connection source 120 and connection target 125, the first speaker enclosure 105 and the second speaker enclosure 110 may be attached to each other such that they will be more manageable. For example, a first cord 140 and a second cord 145 and the first speaker enclosure 105 and second speaker enclosure 110 may be less likely to become tangled as the first speaker enclosure 105 and second speaker enclosure 110 will be connected and they will not swing around each other, becoming tangled. In addition, the connection source 120 and connection target 125 may be used to hold the speaker enclosures 105 110 together when the first cord 140 and second cord 145 are wrapped around an object, such a user's neck, hang from a hook, be wrapped around a book, etc. In an embodiment where there is no first cord 140 and second cord 145 such as when the speakers operate wirelessly using a receiver inside each speaker enclosure 105 110, the connection source 120 and connection target 125 may be used to keep the first speaker enclosure 105 and second speaker enclosure 110 together when not in use.

Figure 3:
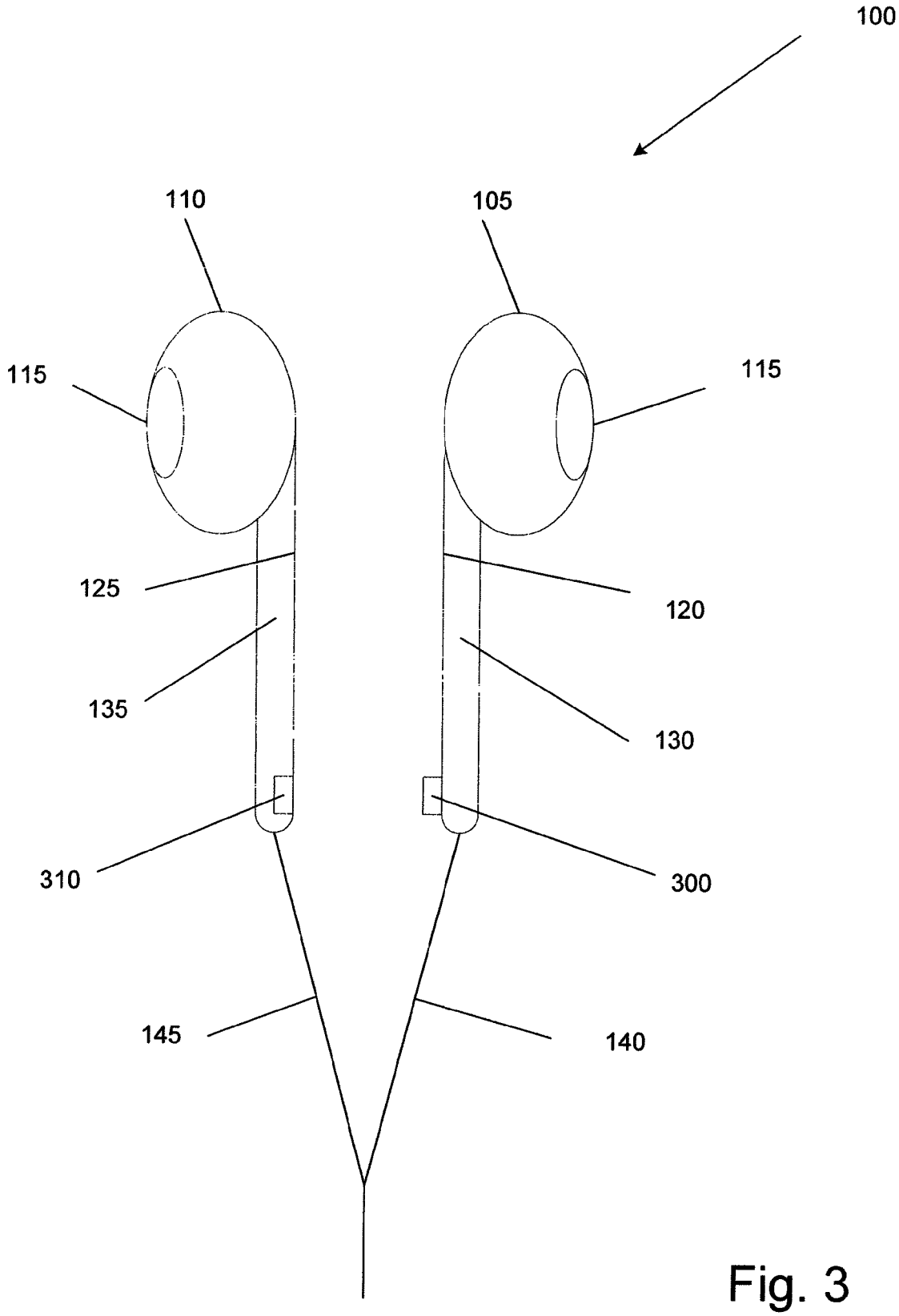
FIG. 3 is an illustration of a set of personal speakers with an alignment device and an alignment receiver.

Referring to FIG. 3, in another embodiment, the first speaker enclosure 105 may have an alignment device 300 for aligning the first speaker enclosure 105 with the second speaker enclosure 110. The alignment device 300 may fit into an alignment receiver 310 on the second speaker enclosure 110. The alignment device 300 may be a nub or raised circle and the alignment receiver 310 may be a circular depression in which the nub fits without excess force or excessive play. In another embodiment, the nub may be a square, triangular or rectangular shape (with related shaped receivers 310) such that the nub will have less rotation than a circular numb. In yet another embodiment, the alignment device 300 may be a finger like projection and the alignment receiver 310 may be a slot or hole in which the finger may fit without excessive force or excessive play. Of course, other alignment devices are possible.

The alignment device 300 in the first speaker enclosure 105 may be located at a first end of the first stem 130 and the connection source 120 may be located at an end at an end opposite of the alignment device 300. For example, in FIG. 3, the alignment device 300 may be located in the first stem 130 in the end opposite the speaker 115 and the connection source 120 may be located near the speaker 115 end of the first stem 130. Related, the alignment receiver 310 may be located in the second stem 135 in the end opposite the speaker 115 and the connection target 125 may be located near the speaker 115 end of the second stem 135. As a result of such an arrangement, the stems 130 135 may line up as in FIG. 1. In addition, with two sources of alignment (the connection source 120/connection target 125 and the alignment device 300/alignment receiver 310) the stems 130 135 will be less likely to twist or rotate. Of course, the alignment device 300/receiver 310 may be at the end of the stems 130 135 near the speakers 115 and the connection source 120/connection target 125 may be at the end of the stems 130 135 opposite the speakers 115. In one embodiment, by placing the magnet at a point as close to the end of the enclosures 105 110 (near the speaker 115 end) as possible, the length of loose structure may be limited and the reduction of twisting and tangling may be maximized.

Figure 4:
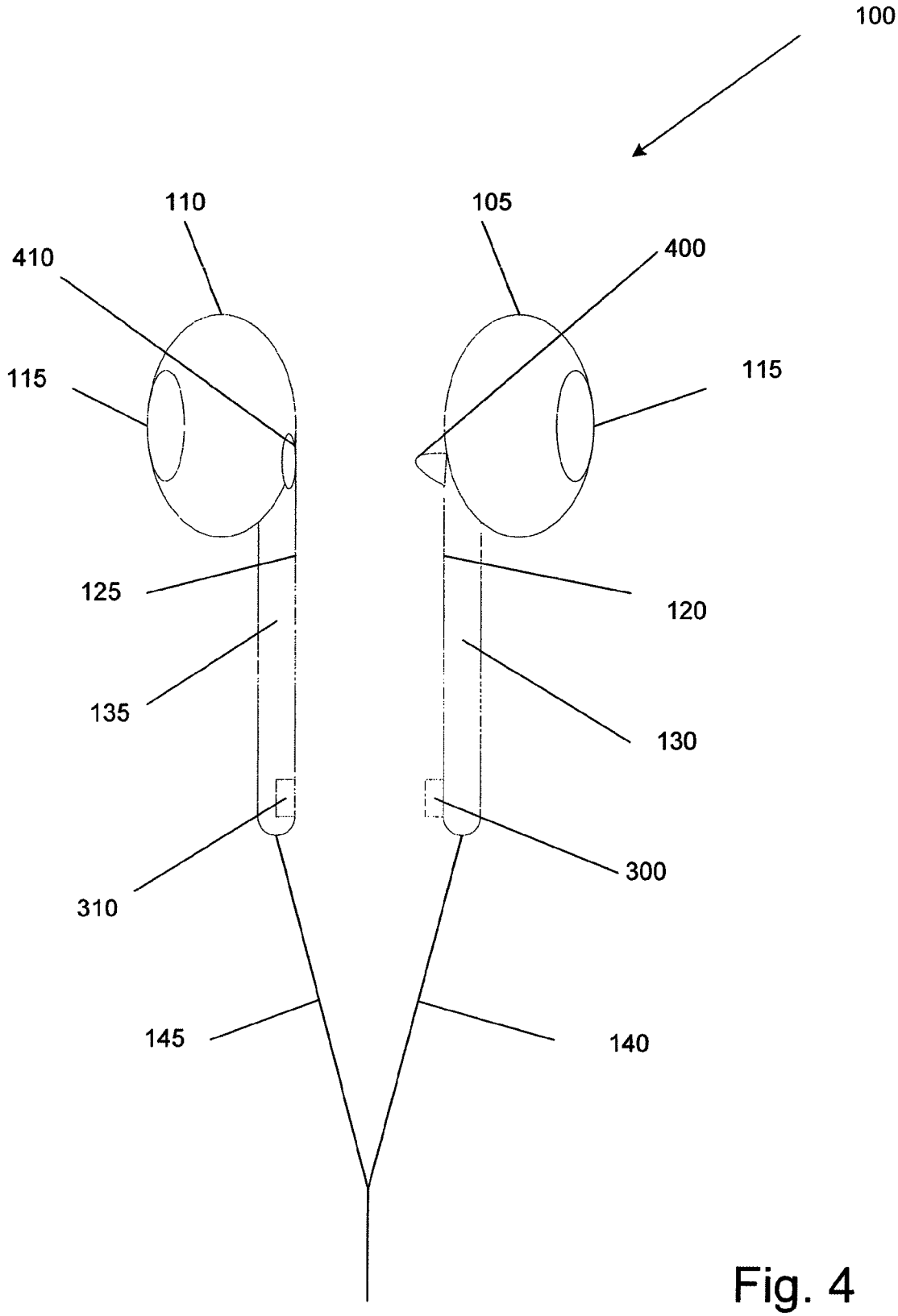
FIG. 4 is an illustration of a set of personal speakers with an alignment device, an alignment receiver, a second alignment device and a second alignment receiver.

FIG. 4 may be yet another embodiment of the speaker set 100. In this embodiment, the first speaker enclosure 105 may have the alignment device 300 and a second alignment device 400 and the connection source 120 while the second speaker enclosure 110 may have the alignment receiver 310, a second alignment receiver 410 and the connection target 125. The alignment device 300 may be located at a first end of the first speaker enclosure 105 and the second alignment device 400 may be located at an opposite end of the first end of the first speaker enclosure 105. Related, the alignment receiver 310 may be located at the first end of the second speaker enclosure 110, the second alignment receiver 410 may be located at an end opposite of the first end of the second speaker enclosure 115. In addition, the connection source 120 may be located in the first stem 130 and the connection target 125 may be located in the second stem 135. As a result, the alignment device and the alignment receiver may fit together and the second alignment device and the second alignment receiver may fit together such that the first stem and second stem are in alignment and that the first speaker is opposite the second speaker.

As mentioned previously, there are a wide variety of potential alignment devices to be the alignment device 300 and the second alignment device 400. In one embodiment, the alignment device 300 or the second alignment device 400 may be magnets. In another embodiment, the alignment device 300 or second alignment device 400 may be a nub and receiver combination of virtually any shape. In yet another embodiment, the alignment device 300 or second alignment device 400 may be fingers that fit into receivers 310, 410 such as a slot or a hole designed to receive the finger. In addition, the receiver 310, 410 may have a lining which may have grip to ensure the alignment device 400 stays inside the receiver 310, 410 when desired but can be separated with sufficient effort. Of course, the various alignment devices may be mixed and matched into a variety of different embodiments.

An additional benefit of the alignment device 300, the second alignment device 400, the alignment device receiver 310 or the second alignment device receiver 410 may be that the various alignment apparatus may be installed in a predictable manner to indicate to a user which speaker enclosure 105, 110 is the right speaker enclosure and which is the left speaker enclosure. For example, if the alignment device 300 is a nub, the nub may be consistently installed on the right or first speaker enclosure 105. As a result, a user can tell which speaker enclosure (105 or 110) is the right speaker enclosure (105 or 110) and which is the left speaker enclosure (105 or 110) by feel and without looking at the speaker enclosures (105 or 110). Similarly, the alignment devices 300 or 400 such as fingers or T-shaped connectors may provide tactile feedback to indicate which speaker enclosure 105, 110 is left or right.

Although the forgoing text sets forth a detailed description of numerous different embodiments, it should be understood that the scope of the patent is defined by the words of the claims set forth at the end of this patent. The detailed description is to be construed as exemplary only and does not describe every possible embodiment because describing every possible embodiment would be impractical, if not impossible. Numerous alternative embodiments could be implemented, using either current technology or technology developed after the filing date of this patent, which would still fall within the scope of the claims.

Thus, many modifications and variations may be made in the techniques and structures described and illustrated herein without departing from the spirit and scope of the present claims. Accordingly, it should be understood that the methods and apparatus described herein are illustrative only and are not limiting upon the scope of the claims.

The invention claimed is:

1. A speaker set comprising a first speaker enclosure and a second speaker enclosure, wherein the first speaker enclosure comprises a first speaker;

a connection source for connecting the first speaker enclosure to the second speaker enclosure wherein the connection source comprises one selected from the group comprising:

a magnet;

a first Velcro piece; and a T-shape projection and;

an alignment device for aligning the first speaker enclosure with the second speaker enclosure wherein the alignment device fits into an alignment receiver on the second speaker enclosure; and a second alignment device; and wherein the second speaker enclosure comprises a second speaker;

a connection target for the first connection source wherein the connection source connects to the connection target, wherein the connection target comprises one selected from the group comprising:

a material attracted to the magnet;

a second Velcro piece that sticks to the first Velcro piece; and a receiving slot in which the T-shaped projection is inserted and twisted to couple the first speaker and second speaker together;

the alignment receiver for receiving the alignment device from the first speaker enclosure; and a second alignment receiver.

2. The speaker set of claim 1, the first speaker enclosure further comprises a first stem, wherein the first stem has a length longer than a width; and the second speaker enclosure further comprises a second stem wherein the second stem has a length longer than a width.

3. The speaker set of claim 2, wherein a magnet is part of the first stem and the connection target is part of the second stem.

4. The speaker set of claim 3, wherein the magnet has a length longer than a width and the magnet is disposed along the length of the first stem;

wherein the connection target has a length longer than a width and the connection target is disposed along the length of the second stem; and wherein the length of the first stem will be attracted to the length of the second stem such that the first stem and second stem will align and the first speaker will be aligned opposite of the second speaker.

5. The speaker set of claim 2, wherein:

the alignment device in the first speaker enclosure is located at a first end of the first stem; and wherein the connection source in the first speaker enclosure is located in the first stem at an end opposite of the alignment device.

6. The speaker set of claim 5, wherein:

the alignment device is located at a first end of the first speaker enclosure;

the second alignment device is located at an opposite end of the first end of the first speaker enclosure;

the alignment receiver is located at a first end of the second speaker enclosure;

the second alignment receiver is located at an end opposite of the first end of the second speaker enclosure;

the alignment device and the alignment receiver fitting together and the second alignment device and the second alignment receiver fitting together such that the first stem and second stem are in alignment and that the first speaker is opposite the second speaker.

7. The speaker set of claim 6, wherein:

the alignment device comprises a magnet;

the alignment receiver comprises a material attracted by the magnet;

the second alignment device comprises a second magnet;

the second alignment device comprises a material attracted by the second magnet.

8. The speaker set of claim 6, wherein the connection source in located between the alignment device and the second alignment device and wherein the connection target is located between the alignment receiver and the second alignment receiver.

9. The speaker set of claim 1, wherein the alignment device is a nub or a finger and the alignment receiver is a nub receiver or a finger receiver.

10. The speaker set of claim 1, wherein the alignment device indicates whether the speaker enclosure is a right speaker enclosure or a left speaker enclosure.

11. A pair of speaker enclosures comprising a first speaker enclosure and a second speaker enclosure wherein the first speaker enclosure comprises:

a first speaker;

a first stem, wherein the first stem has a length longer than a width; and a connection source for connecting the first speaker enclosure to the second speaker enclosure;

an alignment device for aligning the first speaker enclosure with the second speaker enclosure wherein the alignment device fits into an alignment receiver on the second speaker enclosure;

a second alignment device; and the second speaker enclosure further comprises a connection target for connecting to the connection source of the first speaker enclosure;

a second speaker;

a second stem wherein the second stem has a length longer than a width; and the alignment receiver for receiving the alignment device from the first speaker enclosure; and a second alignment receiver.

12. The pair of speaker enclosures of claim 11, wherein the connection source comprises one selected from the group comprising:

a magnet;

a first Velcro piece; and a T-shape projection and wherein the connection target comprises one selected from the group comprising:

a material attracted to the magnet;

a second Velcro piece; and a receiving slot in which the t-shaped projection is inserted and twisted to couple the first speaker and second speaker together.

13. A method of connecting a first speaker enclosure to a second speaker enclosure comprising:

selecting a connection source that connects to a connection target;

creating a first speaker enclosure wherein the first speaker enclosure comprises a first speaker, a first stem wherein the first stem has a length longer than a width and the connection source for connecting the first speaker enclosure to the second speaker enclosure;

an alignment device for aligning the first speaker enclosure with the second speaker enclosure wherein the alignment device fits into an alignment receiver on the second speaker enclosure; and a second alignment device;

and creating a second speaker enclosure wherein the second speaker enclosure comprises a second speaker, a second stem wherein the second stem has a length longer than a width and the connection target for the first connection source;

the alignment receiver for receiving the alignment device from the first speaker enclosure; and a second alignment receiver.

14. The method of claim 13, further comprising:

attaching an alignment device to the first speaker enclosure for aligning the first speaker enclosure with the second speaker enclosure wherein the alignment device fits into an alignment receiver on the second speaker enclosure; and including the alignment receiver in the second speaker enclosure for receiving the alignment device from the first speaker enclosure.

* * * * *